US009660326B2

(12) United States Patent
Martiskainen et al.

(10) Patent No.: US 9,660,326 B2
(45) Date of Patent: May 23, 2017

(54) CONDUCTIVE LOOP ANTENNAS

(71) Applicant: Galtronics Corporation Ltd., Tempe, AZ (US)

(72) Inventors: Matti Martiskainen, Tiberias (IL); Jongmin Na, Suwon-si (KR); Eeungyu Bae, Suwon-si (KR); Taihong Kim, Busan (KR)

(73) Assignee: GALTRONICS CORPORATION, LTD., Tiberias (IL)

( * ) Notice: Subject to any disclaimer, the term of this patent is extended or adjusted under 35 U.S.C. 154(b) by 0 days.

(21) Appl. No.: 14/601,799

(22) Filed: Jan. 21, 2015

(65) Prior Publication Data

US 2015/0207211 A1 Jul. 23, 2015

Related U.S. Application Data

(60) Provisional application No. 61/954,685, filed on Mar. 18, 2014, provisional application No. 61/944,638, filed on Feb. 26, 2014, provisional application No. 61/930,029, filed on Jan. 22, 2014, provisional application No. 61/971,650, filed on Mar. 28, 2014.

(51) Int. Cl.

| | |
|---|---|
| ***H01Q 1/24*** | (2006.01) |
| ***H01Q 21/30*** | (2006.01) |
| ***H01Q 7/00*** | (2006.01) |
| ***H01Q 5/371*** | (2015.01) |
| ***H01Q 5/307*** | (2015.01) |
| ***H01Q 13/10*** | (2006.01) |
| ***H01Q 9/42*** | (2006.01) |

(52) U.S. Cl.
CPC ..... *H01Q 1/243* (2013.01); *H01Q 5/307* (2015.01); *H01Q 5/371* (2015.01); *H01Q 7/00* (2013.01); *H01Q 9/42* (2013.01); *H01Q 13/10* (2013.01); *H01Q 21/30* (2013.01)

(58) Field of Classification Search
CPC ..... H01Q 1/243; H01Q 5/364; H01Q 7/00; H01Q 21/30; H01Q 5/307
See application file for complete search history.

(56) References Cited

U.S. PATENT DOCUMENTS

2001/0007445 A1 7/2001 Pankinaho
2005/0259013 A1 11/2005 Gala Gala et al.
(Continued)

OTHER PUBLICATIONS

U.S. Appl. No. 14/601,758, filed Jan. 21, 2015.
(Continued)

*Primary Examiner* — Hoang Nguyen
*Assistant Examiner* — Michael Bouizza
(74) *Attorney, Agent, or Firm* — Lorenz & Kopf, LLP.

(57) ABSTRACT

A antenna for a wireless device is provided. The antenna may include a dielectric substrate, a counterpoise disposed on the dielectric substrate, a first conductive element electrically connected to the counterpoise, and a second conductive element electrically connected to a feed point. The first conductive element may form at least a portion of a radiating loop resonant at a first frequency, and the second conductive element may form at least a portion of a radiating spur resonant at a second frequency higher than the first frequency. The antenna may further include a conductive frame constituting at least a portion of the radiating loop or the radiating spur.

22 Claims, 7 Drawing Sheets

(56) References Cited

U.S. PATENT DOCUMENTS

| | | | | |
|---|---|---|---|---|
| 2011/0001673 | A1* | 1/2011 | You | H01Q 1/243 343/702 |
| 2011/0018777 | A1 | 1/2011 | Brown | |
| 2011/0263289 | A1 | 10/2011 | Vance | |
| 2012/0081252 | A1 | 4/2012 | Pan | |
| 2012/0235866 | A1 | 9/2012 | Kim et al. | |
| 2012/0268328 | A1* | 10/2012 | Kim | H01Q 1/243 343/702 |
| 2012/0299785 | A1 | 11/2012 | Bevelacqua | |
| 2012/0306521 | A1 | 12/2012 | Nickel | |
| 2012/0306709 | A1 | 12/2012 | Wu et al. | |
| 2013/0027254 | A1* | 1/2013 | Korva | H01Q 7/00 343/702 |
| 2013/0057437 | A1* | 3/2013 | Chiu | H01Q 1/243 343/702 |
| 2013/0135158 | A1* | 5/2013 | Faraone et al. | 343/702 |

OTHER PUBLICATIONS

USPTO, Office Action for U.S. Appl. No. 14/601,758 mailed Mar. 25, 2015.
USPTO, Final Office Action in U.S. Appl. No. 14/601,758 mailed Sep. 24, 2015.
U.S. Appl. No. 14/601,778, filed Jan. 21, 2015.
USPTO, Office Action for U.S. Appl. No. 14/601,778, mailed Apr. 7, 2015.
USPTO, Final Office Action for U.S Appl. No. 14/601,778 mailed Sep. 24, 2015.
U.S. Appl. No. 14/601,812, filed Jan. 21, 2015.

* cited by examiner

CONDUCTIVE LOOP ANTENNAS

RELATED APPLICATIONS

This application claims the benefit of priority under 35 U.S.C. §119(e) to U.S. Provisional Application No. 61/954,685, filed Mar. 18, 2014, U.S. Provisional Application No. 61/944,638, filed Feb. 26, 2014, U.S. Provisional No. 61/930,029, filed Jan. 22, 2014, and U.S. Provisional Application No. 61/971,650, filed Mar. 28, 2014, the disclosures of each of which are incorporated herein by reference.

TECHNICAL FIELD

The present disclosure relates to antenna structures for wireless devices. Wireless devices described herein may be used for mobile broadband communications.

SUMMARY

Embodiments of the present disclosure may include an antenna for a wireless device, comprising, a dielectric substrate, a counterpoise disposed on the dielectric substrate, a first conductive element electrically connected to the counterpoise, and a second conductive element electrically connected to a feed point. The first conductive element may form at least a portion of a radiating loop resonant at a first frequency, and the second conductive element may form at least a portion of a radiating spur resonant at a second frequency higher than the first frequency.

Another embodiment consistent with the present disclosure may include a wireless device, comprising, a housing, a continuous conductor on an external portion of the housing, a feed line terminating in a first feed point and a second feed point within the housing, a first radiating loop, coupled to the first feed point, and including at least a first portion of the continuous conductor, the first radiating loop being configured to serve as a first antenna, and a second radiating loop, coupled to the second feed point, and including at least a second portion of the continuous conductor, the second radiating loop being configured to serve as a second antenna.

In still another embodiment consistent with the present disclosure a wireless device may include a dielectric substrate, a counterpoise disposed on the dielectric substrate, a conductive frame disposed around the dielectric substrate. A connector element may connect the conductive frame to the counterpoise. The connector element may cooperate with at least a portion of the conductive frame and the counterpoise to define a first antenna resonant in a first frequency. The device may further include a second antenna, sandwiched between the conductive frame and the counterpoise. The second antenna may be configured to resonate in a second frequency.

DETAILED DESCRIPTION OF THE EMBODIMENTS

Reference will now be made in detail to exemplary embodiments of the present disclosure, examples of which are illustrated in the accompanying drawings. Wherever possible, the same reference numbers will be used throughout the drawings to refer to the same or like parts.

Embodiments of the present disclosure relate generally to wide bandwidth antennas provided for use in wireless devices. Multi-band antennas consistent with the present disclosure may be employed in mobile devices for cellular communications, and may operate at frequencies ranging from approximately 700 MHz to approximately 2.8 GHz. Multi-band antennas consistent with the present disclosure may further be employed for any type of application involving wireless communication and may be constructed to operate in appropriate frequency ranges for such applications. Multi-band antennas consistent with the present disclosure may include dual branched antennas configured to operate in multiple frequency bands.

As used herein, the term antenna may collectively refer to the structures and components configured to radiate radiofrequency energy for communications. The term antenna may collectively refer to the multiple conductive components and elements combining to create a radiating structure. The term antenna may further include additional tuning, parasitic and trim elements incorporated into a wireless device to improve the function of radiating structures. The term antenna may additionally include discreet components, such as resistors, capacitors, and inductors and switches, connected to or incorporated with antenna components. As used herein, the term antenna is not limited to those structures that radiate radiofrequency signals, but also includes structures that serve to feed signals to radiating structures as well as structures that serve to shape or adjust radiation patterns.

Multi-band antennas consistent with the present disclosure may be efficacious for providing wideband communications in cellular frequency ranges, e.g., between 700 MH and 2.7 GHz. Multi-band antennas consistent with the present disclosure may be incorporated into wireless devices, such as mobile phones and tablets.

Wireless devices described herein may be illustrated with specific form-factors. For example, a wireless device may be illustrated as having a form-factor of a typical smartphone or a tablet computer. Wireless devices as described herein, however, are not limited to the form factors illustrated. Antennas disclosed herein may be suitable for use with wireless devices having various other form factors, such as laptop computers, wearable devices, watches, etc.

Figure 1A:
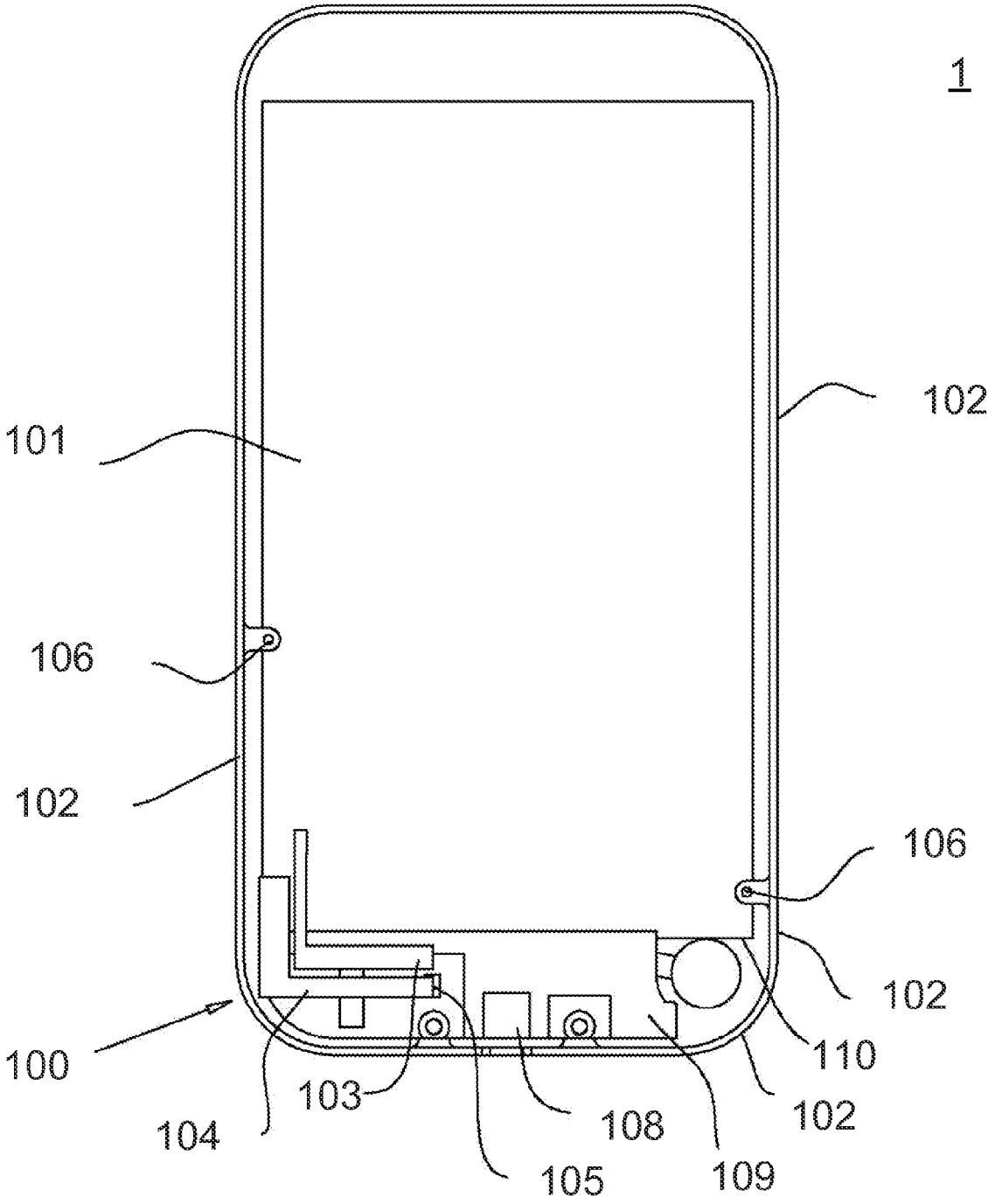
FIGS. 1*a* and 1*b*. illustrate an exemplary antenna consistent with the disclosure.
Figure 1B:
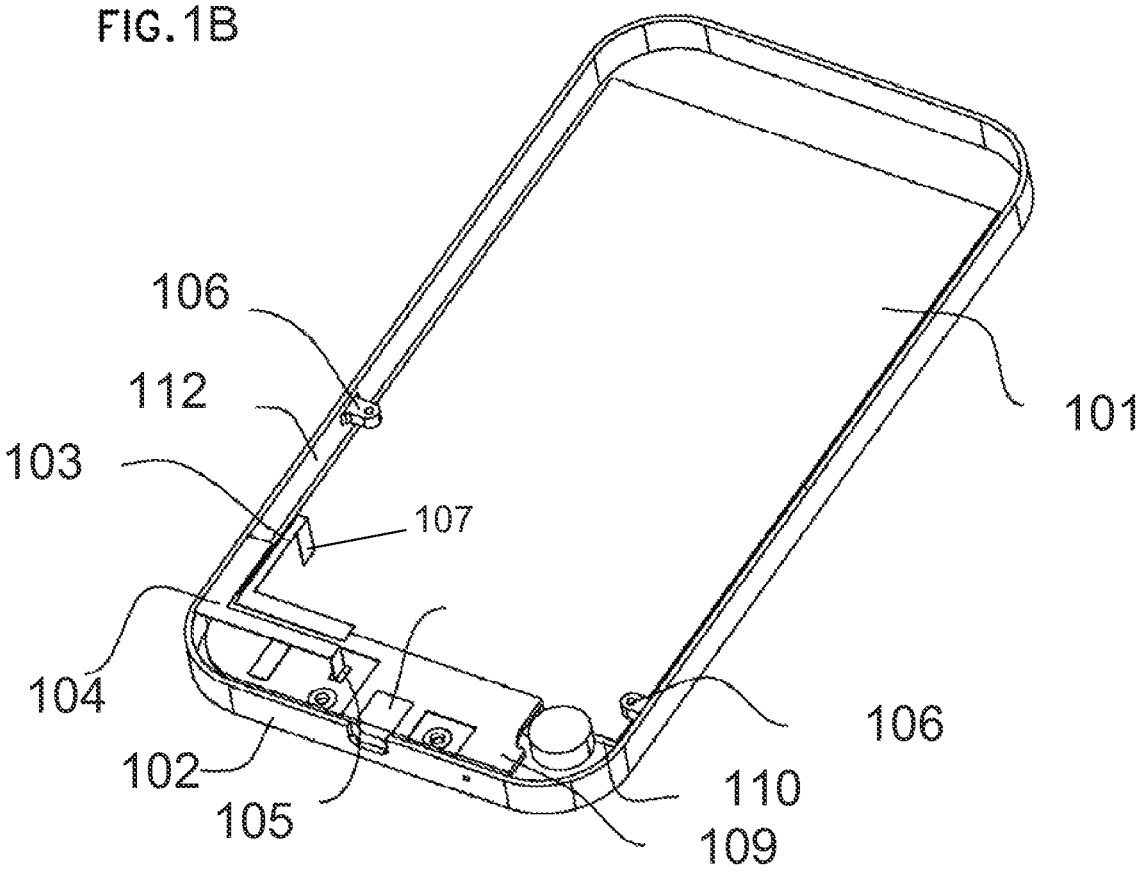

FIGS. 1*a* and 1*b* illustrate a multi-band loop and spur antenna for a wireless device consistent with the present disclosure. Multi-band loop and spur antenna 100 for wireless device 1 may include a counterpoise 101 disposed on a dielectric substrate (not shown), a conductive loop element 102, a conductive coupling element 103, and a feeding element 104. Feeding element 104 may receive a radiofrequency signal via a feed point 105. Conductive coupling element 103 may be connected to counterpoise 101 via connection strut 107. Conductive loop element 102 may be connected to counterpoise 101 via at least one counterpoise connector 106.

Wireless device 1 may include a counterpoise 101. Counterpoise 101 may be a conductive element forming at least a portion of a grounding region of loop and spur antenna 100. Counterpoise 101 may be formed on a substrate and may be formed of various structures within wireless device 1. Counterpoise 101 may include ground edge 110. Ground edge 110 may be, as illustrated in FIG. 1*a*, a substantially straight, elongated edge of counterpoise 101. In other embodiments, ground edge 110 may have a curved, wavy, labyrinthine, or other non-linear configuration. In some embodiments, ground edge 110 may have linear and non-linear portions. In some embodiments, counterpoise 101 may be galvanically connected to, i.e., at one or more counterpoise connectors 106, conductive loop element 102. While FIG. 1*a* illustrates counterpoise 101 as a regular, elongated rectangle, counterpoise 101 may be formed of any suitable shape and size. In particular, counterpoise 101 may be configured to accommodate other components located within wireless device 1.

Conductive loop element 102 may be an electrically conductive structure forming a loop. In some embodiments, conductive loop element 102 may be a single continuous loop structure. In alternative embodiments, conductive loop element 102 may include electrical discontinuities, or gaps. As used herein, "electrical discontinuities" may refer to gaps or other structures substantially preventing the flow of current. Such gaps may be occupied by dielectric material, for example air, plastic, and teflon. Conductive loop element 102 may form a loop surrounding a periphery 112 of other components of loop and spur antenna 100. For example, conductive loop element 102 may surround counterpoise 101, coupling element 103, and feed element 104. Conductive loop element 102 may be galvanically connected to counterpoise 104 via at least one counterpoise connector 106. As used herein, "galvanically connected" or "electrically connected" may refer to components that are mechanically connected or otherwise in contact with one another such that a continuously conductive pathway is formed.

In some embodiments, conductive loop element 102 may be located at an external periphery of wireless device 1, and may therefore form at least a portion of an external housing of wireless device 1. In some embodiments, conductive loop element 102 may be a conductive frame or conductive bezel surrounding a portion or an entirety of wireless device 1. Conductive loop element 102 may be configured as a continuous frame or bezel, surrounding an entirety of wireless device 1 with no electrical discontinuities. Such a continuous conductive frame may be gapless, and may form a closed loop. When configured as a conductive bezel, conductive loop element 102 may be provided to secure a screen or other components to wireless device 1. In embodiments wherein conductive loop element 102 is configured as a conductive frame or bezel, loop and spur antenna 100 may be a conductive frame antenna. Conductive loop element 102 may be coupled, galvanically or otherwise, to other conductive elements of wireless device 1 to serve as at least a portion of a radiating antenna structure. For example, at least a portion of conductive loop element 102 may be configured to radiate when activated with an appropriate frequency signal.

Conductive loop element 102 may be electrically coupled, galvanically or otherwise, to other conductive elements of wireless device 1 to serve as at least a portion of a radiating antenna structure. As used herein, "electrically coupled" refers to elements that are configured so as to permit the transfer of current from one to the other. Galvanic coupling, for example, may involve a direct conductive connection. Elements may also be, for example, capacitively or inductively coupled, and may be coupled without a direct physical connection. For example, two elements arranged in proximity to one another may couple together and permit the transfer of current from one to the other.

Feed element 104 may extend adjacent to edge 110 of counterpoise 101. Feed element may receive a radiofrequency input signal at feed point 105. Feed element 105 may be located on a same plane as counterpoise 101, or, as illustrated in FIG. 1*a*, may be located in a different plane from counterpoise 101. When located in a different plane, feed element 105 may be arranged such that a projection of feed element 105 onto the plane of counterpoise 101 overlaps with counterpoise 101.

Coupling element 103 may be coupled, galvanically or otherwise, to counterpoise 101. As illustrated in FIG. 1A, coupling element 103 may be galvanically coupled to, and may extend perpendicularly from counterpoise 101, via e.g., connecting strut 107. Coupling element 103 may be located in proximity to feed element 105 and may be located in a same plane as or in a different plane from feed element 105. Coupling element 103 may be located between feed element 105 and an edge 110 of counterpoise 101, as illustrated in FIG. 1*a*. In some embodiments, these positions may be reversed, and feed element 105 may be located between coupling element 103 and edge 110 of counterpoise 101. When located "between" feed element 105 and edge 110 of counterpoise 101, it is not required that coupling element 103 be located in a same plane as either of these elements. Coupling element 103 may be between feed element 105 and counterpoise 101 if the projection of coupling element 103 lies between projections of counterpoise 101 and feed element 105 on a same plane.

Additional elements included in conductive frame antenna 1 may include a power connector 108 and insulating segment 109. Power connector 108 may be located so as to be in galvanic communication with counterpoise 101, e.g., via conductive loop element 102.

The structural elements of conductive frame antenna 1 may be configured to operate as a multi-band conductive frame antenna as follows. Conductive loop element 102 may be configured to form at least a portion of a radiating loop. A radiating loop may be formed by conductive loop element 102, counterpoise 101, and at least one counterpoise connector 106. For example, a first portion of a radiating loop may include a section of conductive loop element 102 between two counterpoise connectors 106. A second portion of the radiating loop may span a portion of counterpoise 101 between the same two counterpoise connectors 106. Thus, a radiating loop may be formed by a continuously conductive pathway formed by conductive loop element 102, at least one counterpoise connector 106, and a counterpoise 101. A connector element, e.g., counterpoise connector 106, may cooperate with at least a portion of conductive loop element 102 and counterpoise 101 to form the radiating loop.

The length of the radiating loop, and therefore a frequency band at which it may radiate, may be altered by repositioning counterpoise connectors 106. Altering the radiating loop in this manner may provide at least two advantages. First, if conductive loop element 102 is arranged around a periphery, either internal or external, of wireless device 1, then the length of conductive loop element 102 may be altered by a change in the overall size of wireless device 1. An electrical length of the radiating loop, however, may be kept substantially the same by altering the position of counterpoise connectors 106. Conversely, altering the position of counterpoise connectors 106 may be used to alter an electrical length of a radiating loop to achieve resonance in different frequency ranges without altering other dimensions of a wireless device 1.

As used herein, electrical length refers to the length of a feature as determined by the portion of a radiofrequency signal that it may accommodate. For example, a feature may have an electrical length of A14 (e.g., a quarter wavelength) at a specific frequency. An electrical length of a feature may or may not correspond to a physical length of a structure, and may depend on radiofrequency signal current pathways. Features having electrical lengths that appropriately correspond to intended radiation frequencies may operate more efficiently. Thus, a structural element of an antenna may be sized to be of an appropriate electrical length for a frequency range at which the structure is designed to radiate.

In some embodiments, a radiating loop may include an entirety of a conductive loop element 102. Such an embodiment may also include one or more counterpoise connectors 106 to electrically connect counterpoise 101 to conductive loop element 102. In an embodiment with a single counterpoise connector 106, conductive loop element 102 may be a continuous loop, and be electrically connected to counterpoise 101 via counterpoise connector 106. In an embodiment with multiple counterpoise connectors 106, conductive loop element 102 may terminate at opposite ends at counterpoise connectors 106.

In a low band of operation for loop and spur antenna 100, a radiofrequency signal may be supplied to feed element 104 via feed point 105. Coupling element 103, may be located in proximity to feed element 105 so as to facilitate reactive coupling—capacitive, inductive, or both—between feed element 105 and coupling element 103. The radiofrequency signal may thus be transferred to counterpoise 101, which forms at least a portion of the radiating loop with counterpoise connectors 106 and conductive loop element 102. The radiating loop may define an antenna resonant at a first frequency. For example, in a low band, the radiating loop may activate the counterpoise to form an antenna resonant in a frequency band between 700 and 1200 MHz.

Feed element 104 may be configured to form at least a portion of a radiating spur. A radiating spur, formed at least partially by feed element 104, may be configured to radiate in a second frequency band and/or may define an antenna resonant in the second frequency band. A radiating spur, as illustrated in FIGS. 1*a* and 1*b*, may be sandwiched between conductive loop element 102 and counterpoise 101. Other structural elements of wireless device 1 may form portions of a radiating spur. For example, counterpoise 101 and/or conductive loop element 102 may also form at least a portion of a radiating spur.

In a high band of operation for loop and spur antenna 100, feed element 104 may form at least a portion of a radiating spur resonant at a second frequency. Feed element 104 may be configured to have, for example, an electrical length equivalent to a quarter wavelength, and thus may function as a quarter-wave monopole in a high band of radiation. Feed element 104 may reactively couple to coupling element 103 and therefore to counterpoise 101 and conductive loop element 102, for example to provide to a ground for the antenna. A high frequency band of operation may be between approximately 1700 MHz and 2700 MHz. Wireless device 1 may be configured to transmit and receive signals in both a high band and a low band simultaneously.

In some embodiments consistent with the present disclosure, a second radiating spur may be sandwiched between the conductive loop element 102 and the counterpoise 101. In alternative embodiments, an antenna sandwiched between conductive loop element 102 and counterpoise 101 may not be a radiating spur, but may be an alternative type of antenna, for example, a slot antenna or a loop antenna.

FIGS. 1*a* and 1*b* illustrate one exemplary embodiment of a conductive frame antenna including a radiating loop and a radiating spur. The structures illustrated in FIGS. 1*a* and 1*b* may be departed from without departing from the scope of this disclosure.

Figure 2A:
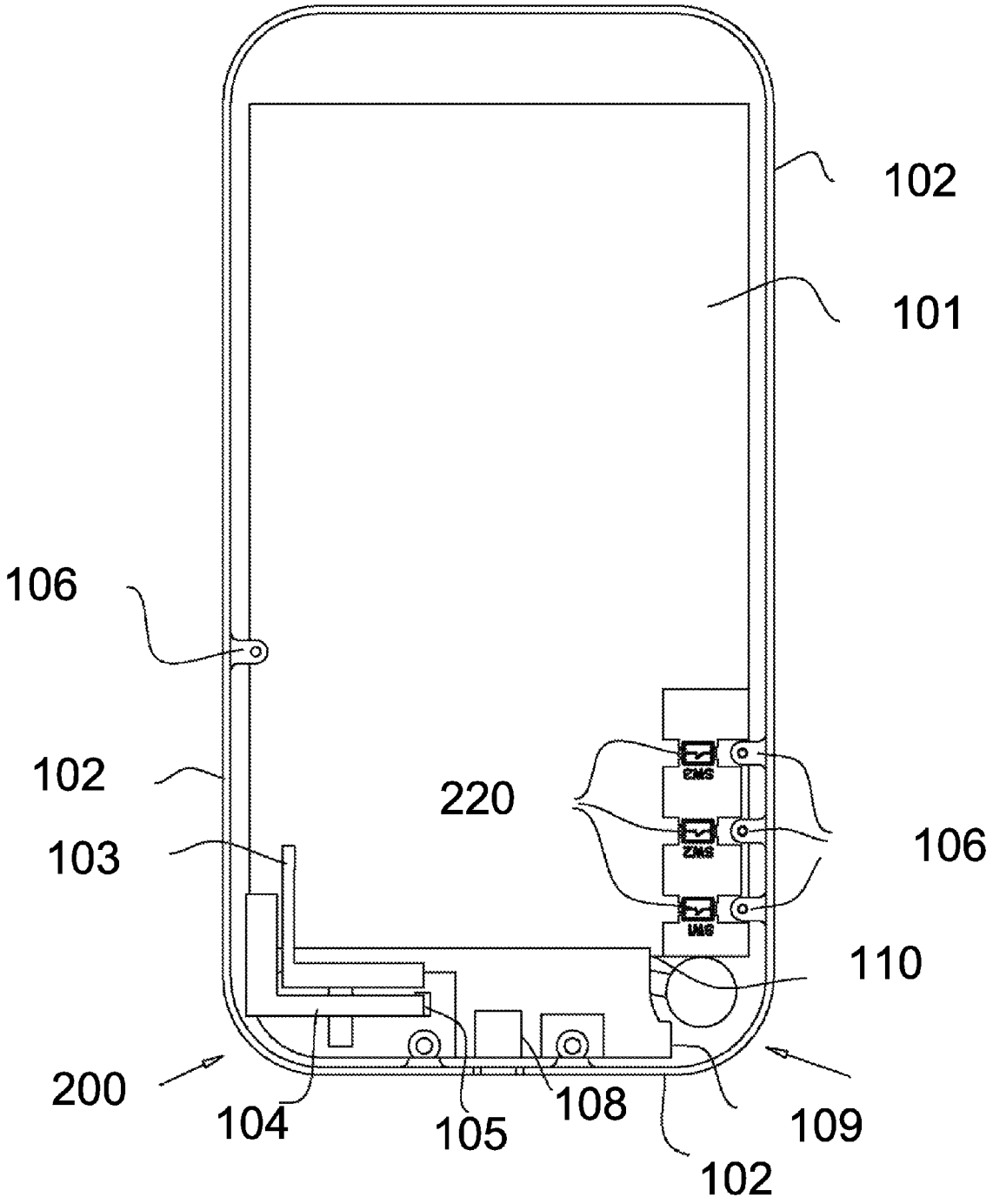
FIGS. 2*a* and 2*b* illustrate an exemplary antenna consistent with the disclosure.
Figure 2B:
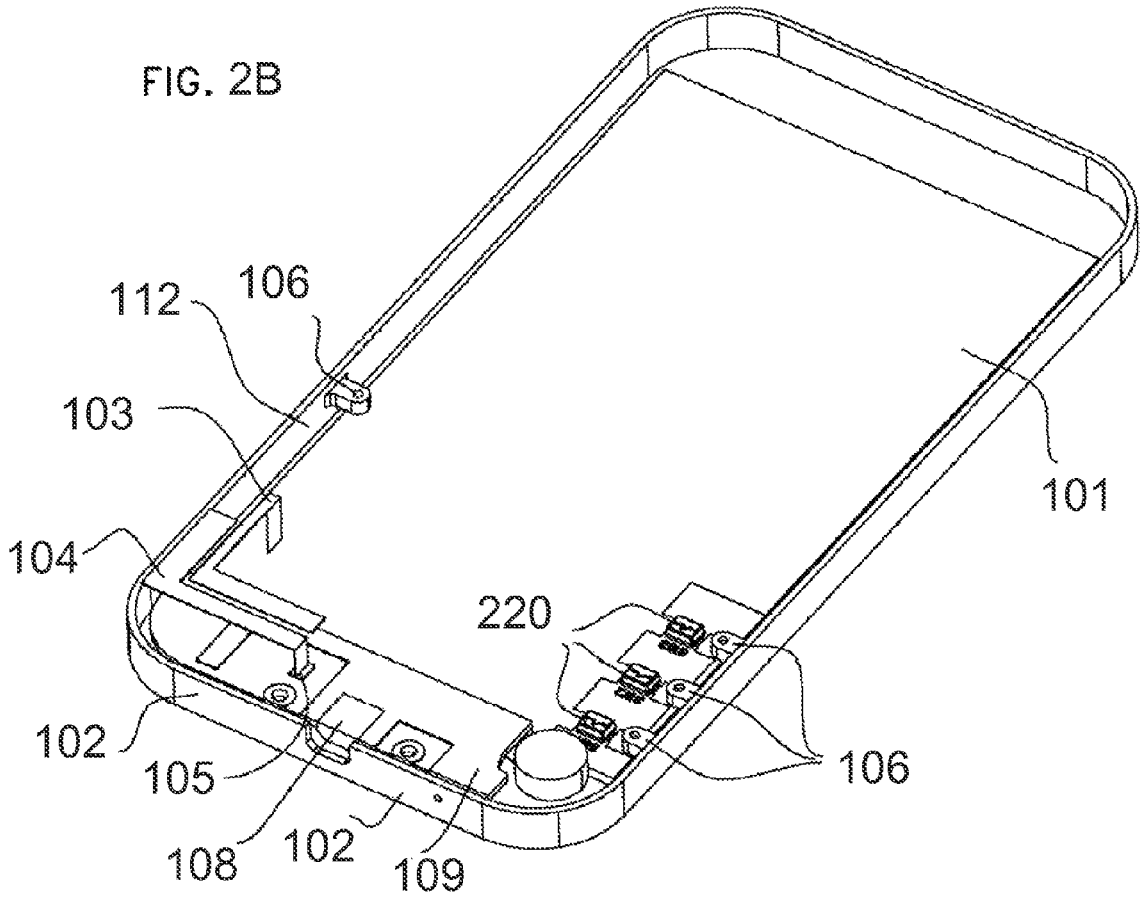

For example, FIGS. 2A and 2B illustrate an alternative embodiment of a loop and spur antenna 200. Conductive frame antenna 200 is similar to loop and spur antenna 100, and includes many similar components that operate in a fashion similar to those of loop and spur antenna 100. In addition to those elements and structures in common with loop and spur antenna 100, loop and spur antenna 200 includes one or more switches 220. As discussed above, altering the location of counterpoise connectors 106 may alter the electrical length of a radiating loop, and thus alter a resonant frequency of the radiating loop. Selective operation of switches 220 may alter a point at which the radiating loop is able to connect to counterpoise 101, and thus alter the length of the radiating loop. Switches 220 may be configured to alter the electrical length of the radiating loop, and thus alter a frequency band in which wireless device 2 is configured to operate.

Switches 220 may be located at various points in wireless device 2 to achieve various results. For example, a configuration of switches 220 may be selected during the design of wireless device 2, before loop and spur antenna 200 is encased in a housing. Selecting a switch configuration at this point may permit the optimization of the frequency band of the radiating loop, for example to optimize use with a particular cellular service provider that uses a specific portion of the frequency spectrum.

In some embodiments, wireless device 2 may be configured with a processor (not shown) configured to dynamically alter a switch configuration. Dynamic alteration may be configured to optimize a resonant frequency of a radiating loop under certain environmental conditions. For example, the way that wireless device 2 is held by a user, or positioned with respect to the body, may alter radiating characteristics of the radiating loop. Dynamic modification of the radiating loop via altering the configuration of at least one switch 220 may permit the optimization of a radiating frequency despite such external interference. In other embodiments, a processor may be configured to dynamically modify a radiating loop electrical length to operate in a frequency band that may have a stronger signal in an area where a user is using wireless device 2. Additional benefits to dynamic modification of a radiating loop length may be recognized by a person of skill in the art.

The use of switches is not limited to modification of a radiating loop length. In alternative embodiments, switches may be used between other structures and components within a wireless device modify electrical lengths of radiating elements, and thereby make adjustments to resonant frequencies without requiring the design and manufacture of wholly different antennas. For example, a radiating spur, at least partially formed by feed element 104 may be configured with a switch such that an electrical length of feed element 104 may be altered in order to adjust a resonant frequency.

Figure 3:
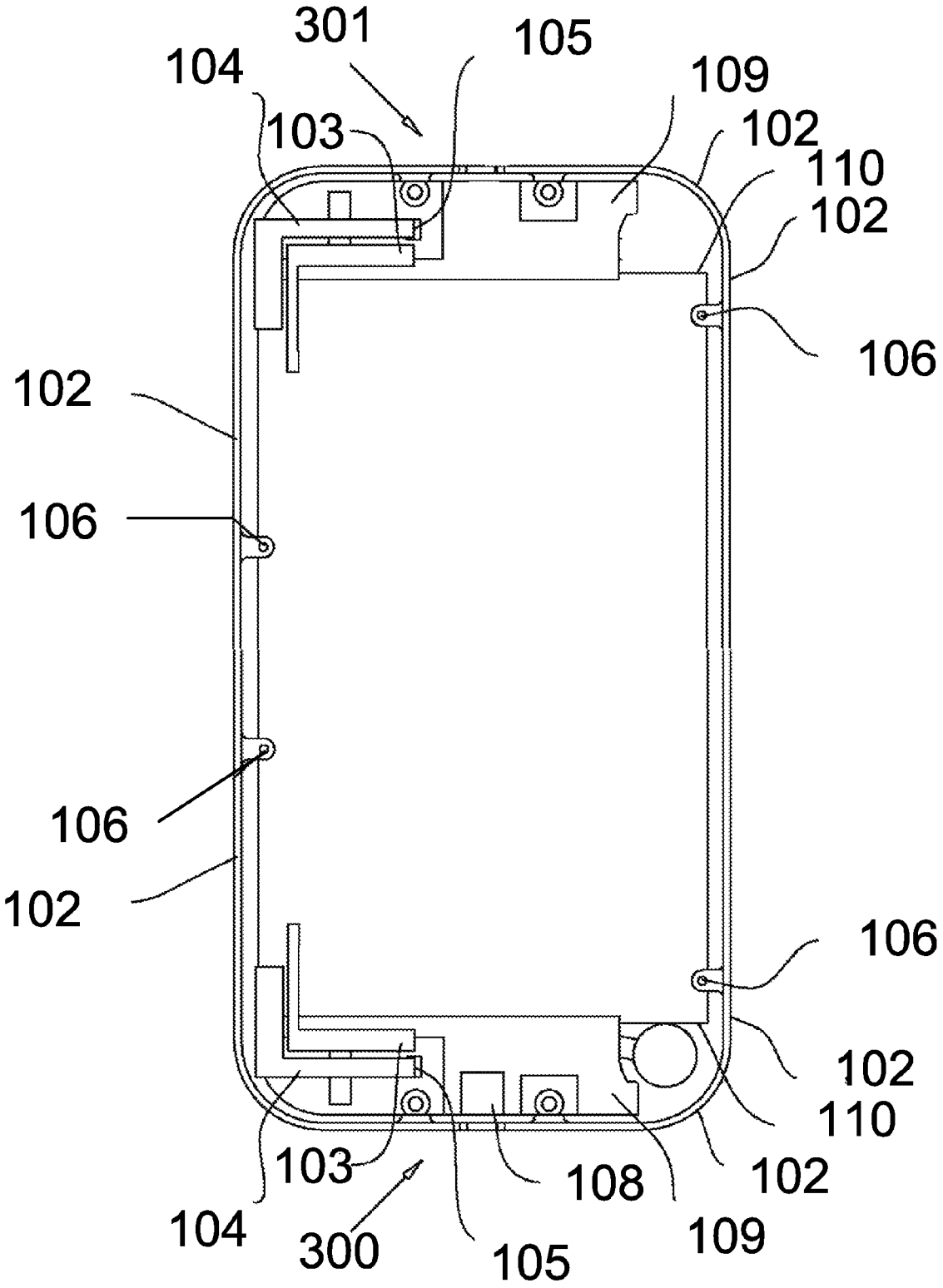
FIG. 3 illustrates an exemplary antenna consistent with the disclosure.

FIG. 3 illustrates a loop and spur antenna consistent with the present disclosure. Wireless device 3, as illustrated in FIG. 3, may include two loop and spur antennas 300, 301. Loop and spur antennas 300, 301 may include any or all of the components and elements of loop and spur antenna 100 and/or loop and spur antenna 200. Loop and spur antennas 300, 301 may be located at opposite ends of a wireless device. Loop and spur antennas 300, 301, may be configured as mirror images of one another, having components of substantially similar sizes and shapes, and thus may be configured to radiate in the same frequency bands. Loop and spur antennas 300, 301 may also be configured to have components of different sizes from one another, and thus may be configured to radiate in different frequency bands. Loop and spur antennas 300, 301 may include components in common. For example, counterpoise 101 may be configured to serve as a counterpoise for both loop and spur antenna 300 and loop and spur antenna 301. Conductive loop element 102 may provide portions of a radiating loop for both antenna 300 and antenna 301.

As described herein, the various radiating elements of wireless device 3 may be configured to radiate at specific frequencies. The frequencies specified herein are exemplary only, and the electrical lengths of the radiating structures may be adjusted to accommodate communications in alternative frequencies. For example, while certain structures may have been described as defining antennas at low frequency bands between 700 MHz and 1200 MHz, such structures may be altered to resonate at lower frequencies, e.g. 300, 400, 500, and/or 600 MHz.

Figure 4:
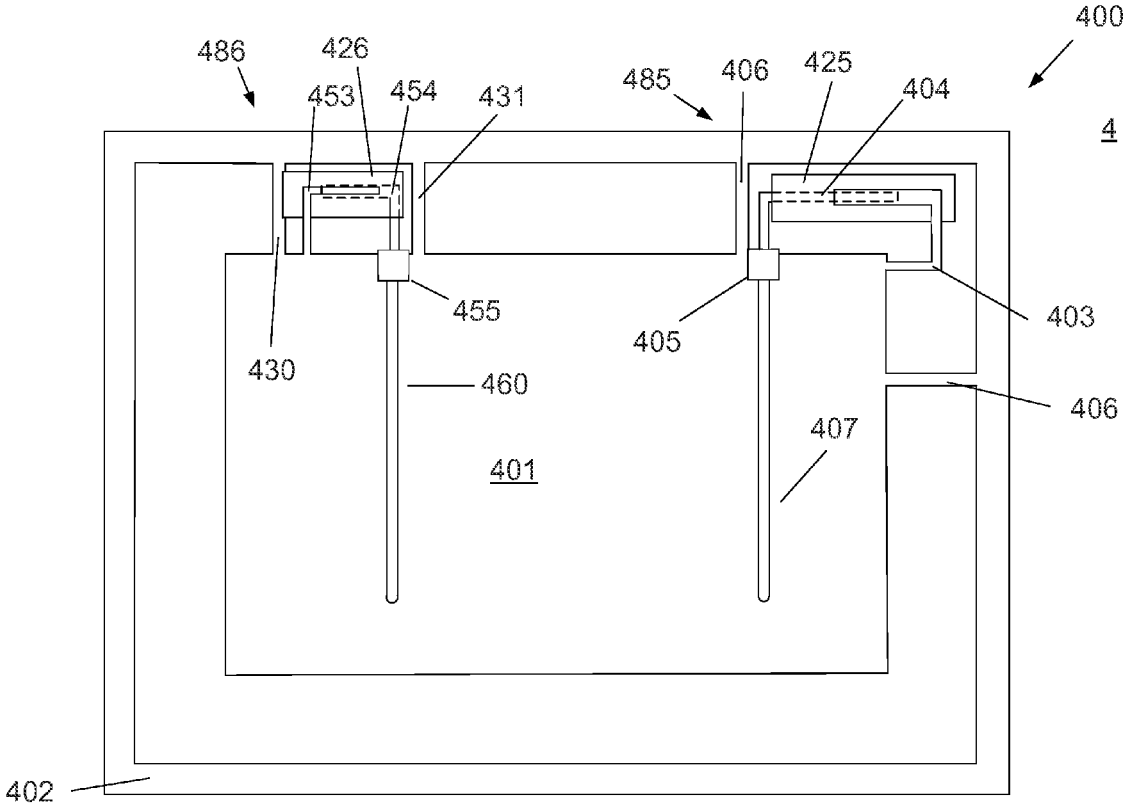
FIG. 4 illustrates an exemplary antenna consistent with the disclosure.

FIG. 4 illustrates a multi-band antenna 400 consistent with the present disclosure. In multi-band antenna 400, a plurality of additional antennas may be sandwiched between counterpoise 401 and conductive loop element 402. Conductive loop element 402 may surround a periphery of counterpoise 401, and may be internal to wireless device 4, or may serve as an external frame or bezel of wireless device 4. Conductive loop element 402 may share many of the same characteristics as conductive loop element 102, described above. For example, conductive loop element 402 may be a continuous conductive frame element, or may include gaps or electrical discontinuities. Any or all of the previously described features of conductive loop element 102 may also pertain to conductive loop element 402.

In wireless device 4, a portion of conductive loop element 402 may serve as at least a portion of an antenna and form, for example, a primary radiating loop. A portion of conductive loop element 402 may cooperate with at least one counterpoise connector 406 and counterpoise 401 to define an antenna. An antenna so defined may be resonant at a first frequency. In some embodiments, a radiating loop antenna of wireless device 4 may be resonant at a low band frequency, e.g. between 700 MHz and 1200 MHz. The radiating loop antenna may receive a radiofrequency signal form feed line 407, by way of feed point 405 and feeding element 404. Feeding element 404 may be arranged in proximity to coupling element 403, so as to permit reactive (capacitive or inductive) coupling between the two elements. As illustrated in FIG. 4, coupling element 403 may be layered atop feeding element 404, with a dielectric portion 425 disposed therebetween. Feeding element 404 is illustrated with a dotted line as passing underneath dielectric portion 425. This structure is somewhat similar to that of the feeding element 104 and coupling element 103 of antenna 100, and may function in a similar fashion.

Wireless device 4 may also radiate in a high band, for example between 1600 MHz and 2800 MHz. A high band antenna structure of wireless device 4 may include first sandwiched antenna 485. First sandwiched antenna 485 may include coupling element 403 and feeding element 404 connected to feed point 405. In a fashion analogous to the radiating spur of antenna 100, feeding element 404 may radiate in a high band as a radiating spur, and may be coupled to counterpoise 401 as a grounding element via coupling element 403. First sandwiched antenna 485 may be configured to resonate in a second frequency. The second frequency may be substantially the same as or substantially different from the first frequency.

A second sandwiched antenna 486 may include a coupling element 453 and a feeding element 454 connected to feed point 455. Second sandwiched antenna may further include first and second counterpoise connection elements 430 and 431. Coupling element 453 may be arranged in proximity to feeding element 454, so as to permit reactive (capacitive or inductive) coupling between the two elements. As illustrated in FIG. 4, coupling element 453 may be layered atop feeding element 454, with a dielectric portion 426 disposed therebetween. Feeding element 454 is illustrated with a dotted line where it passes under dielectric portion 426. When supplied with a radiofrequency signal via feed line 460, second sandwiched antenna may function as an antenna as follows.

Feeding element 454 may receive the radiofrequency signal from feed point 455. Feeding element may reactively couple to coupling element 453, which may serve to supply the radiofrequency signal to a radiating loop formed by cooperation between first and second counterpoise connection elements 430 and 431, conductive loop element 402, and counterpoise 401. The radiating loop thus formed may be configured to radiate at any frequency suitable for wireless communications. The radiating loop of second sandwiched antenna 486 may radiate in a frequency band substantially similar to or substantially different from that of either the primary radiating loop or first sandwiched antenna 485. Second sandwiched antenna 486 may be configured to radiate as a diversity antenna, for example to provide blue-tooth, Wi-Fi, or GPS communications. Each of the antenna structures of FIG. 4 may be configured to transmit and receive signals simultaneously.

It may be appreciated that, although FIG. 4 is illustrated with two sandwiched antennas, multiple additional sandwiched antennas may be provided, functioning as loops or spurs, and may utilize conductive loop 402 and/or counterpoise 401. As described herein, the various radiating elements of wireless device 4 may be configured to radiate at specific frequencies. The frequencies specified herein are exemplary only, and the electrical lengths of the radiating structures may be adjusted to accommodate communications in alternative frequencies. For example, relocating counterpoise connection elements 430 and 431 may serve to alter an electrical length of second sandwiched antenna 486. Likewise, relocation of the at least one counterpoise connector 406 may alter an electrical length of the main radiating loop. Characteristics of first sandwiched antenna 485 may be adjusted, e.g., by altering dimensions of feeding element 404 and coupling element 403.

In some embodiments, wireless device 4 may be a tablet-type wireless device. A tablet-style wireless device may have a larger size than a smartphone. A larger size may permit more space between counterpoise 401 and conductive loop element 402 for locating multiple antennas.

Figure 5:
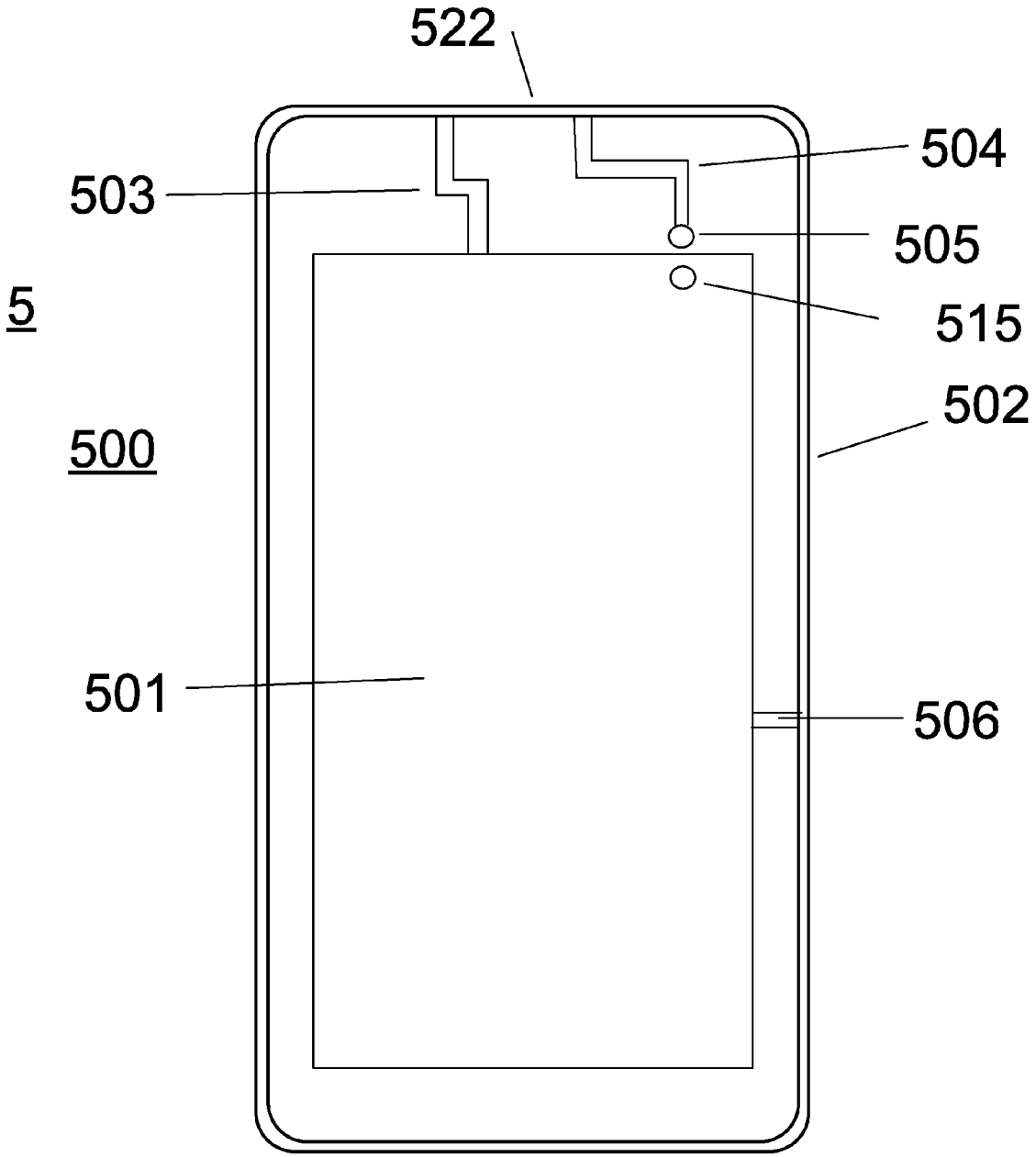
FIG. 5 illustrates an exemplary antenna consistent with the disclosure.

FIG. 5 illustrates a continuous conductive frame antenna consistent with the present disclosure. As illustrated in FIG. 5, conductive frame antenna 500 of wireless device 5 includes conductive loop element 502, counterpoise connector 506, feed element 504, conductive bridge 503, first live feed point 505, and second ground feed point 515.

Conductive loop element 502 of conductive frame antenna 500 may be configured as a continuous frame or bezel, surrounding an entirety of a wireless device with no electrical discontinuities. Such a continuous conductive frame may be gapless, and may form a closed loop. In some embodiments, conductive loop element 502 may also include a conductive bezel configured to securely attach a screen to the wireless device. As illustrated, conductive loop element may surround an external periphery of the wireless device. In alternative embodiments, conductive loop element 502 may be an internal element, completely included or encased with a housing of a wireless device.

Feed element 504 may be galvanically connected at a first end to a live feed point 505, which may receive a radiofrequency signal via a feed line (not shown). Feed element 504 may be galvanically connected at a second end to conductive loop element 502. A ground of the feed line may be connected to second ground feed point 515, located, for example, on counterpoise 501.

Counterpoise 501 may be a conductive element forming at least a portion of a grounding region of antenna 500. Counterpoise 501 may be formed on a dielectric substrate and/or may be formed of various structures within a wireless device. In some embodiments, counterpoise 501 may be galvanically connected to, i.e., at one or more counterpoise connectors 506, conductive loop element 502. While FIG. 5 illustrates counterpoise 501 as a regular, elongated rectangle, counterpoise 101 may be formed of any suitable shape and size. In particular, counterpoise 501 may be configured to accommodate other components located within wireless device 1.

Counterpoise connector 506 may be configured to provide coupling, galvanic or otherwise, between conductive loop element 502 and counterpoise 501. Similarly, conductive bridge 503 may also be configured to provide coupling, galvanic or otherwise, between conductive loop element 502 and counterpoise 501.

In operation, in a low frequency band, for example between 700 MHz and 1200 MHz, a radiofrequency signal may be supplied via feed point 505. Feeding element 504, may supply the signal to a first radiating loop formed by cooperation between conductive loop element 502, counterpoise connector 506, conductive bridge 503, and counterpoise 501. The first radiating loop, therefore, may be coupled to the feed point 505 and may be defined at least partially by a portion of conductive loop element 502. The first radiating loop may be resonant in a first frequency band, and thus may be configured as an antenna in the first frequency band. Resonance of the first radiating loop may be affected by dimensions of counterpoise 501. As discussed above, in some embodiments, conductive loop element 502 may be a continuous conductive frame of a wireless device.

In a high frequency band, for example between 1700 MHz and 2700 MHz, a radiofrequency signal may be supplied to a second radiating loop via feeding element 504. The second radiating loop may be formed via cooperation between feeding element 504, a portion of conductive loop element 502, conductive bridge 503, and at least a portion of counterpoise 501. The second radiating loop, therefore, may be coupled to both the first live feed point 505 and second ground feed 506, and may be defined at least partially by a portion of conductive loop element 502. The second radiating loop may be resonant in a second frequency band, and thus may be configured as an antenna in the second frequency band. Wireless device 5 may be configured to transmit and receive signals in both a high band and a low band simultaneously.

In some embodiments, as illustrated in FIG. 5, the first radiating loop and the second radiating loop may each include at least one common portion 522 of conductive loop element 502. In other embodiments, the first radiating loop and the second radiating loop may each include only separation portions of conductive loop element 502.

As described herein, the various radiating elements of wireless device 5 may be configured to radiate at specific frequencies. The frequencies specified herein are exemplary only, and the electrical lengths of the radiating structures may be adjusted to accommodate communications in alternative frequencies.

The foregoing descriptions of the embodiments of the present application have been presented for purposes of illustration and description. They are not exhaustive and do not limit the application to the precise form disclosed. Modifications and variations are possible in light of the above teachings or may be acquired from practicing the disclosed embodiments. For example, several examples of antennas embodying the inventive principles described herein are presented. These antennas may be modified without departing from the inventive principles described herein. Additional and different antennas may be designed that adhere to and embody the inventive principles as described. Antennas described herein are configured to operate at particular frequencies, but the antenna design principles presented herein are limited to these particular frequency ranges. Persons of skill in the art may implement the antenna design concepts described herein to create antennas resonant at additional or different frequencies, having additional or different characteristics.

Other embodiments of the present application will be apparent to those skilled in the art from consideration of the specification and practice of the embodiments disclosed herein. It is intended that the specification and examples be considered as exemplary only.

What is claimed:

1. A wireless device, comprising:

a housing;

a continuous conductor on an external portion of the housing;

a counterpoise located within the housing;

a first counterpoise connector connecting the continuous conductor to the counterpoise;

a second counterpoise connector connecting the continuous conductor to the counterpoise;

a feed line terminating in a first feed point within the housing;

a feed element connected at the first end thereof to the first feed point;

a coupling element galvanically connected to the counterpoise between the first counterpoise connector and the second counterpoise connector and arranged to capacitively couple to the feed element;

a first radiating loop including at least a first portion of the counterpoise located between the first counterpoise connector and the second counterpoise connector, a first portion of the continuous conductor located between the first counterpoise connector and the second counterpoise connector, the coupling element and the feed element, wherein the first portion of the counterpoise located between the first counterpoise connector and the second counterpoise connector and the first portion of the continuous conductor located between the first counterpoise connector and the second counterpoise connector are configured to radiate at a first frequency to serve as a first antenna when a signal is fed to the feed element causing the coupling element to transfer the signal to the counterpoise; and a radiating spur spurring from the first radiating loop, the radiating spur comprising the feed element coupled to the first feed point and the coupling element, the feed element configured radiate at a frequency to serve as a second antenna.

2. The device of claim 1, wherein the continuous conductor is part of an external bezel of the wireless device.

3. The device of claim 1, wherein the continuous conductor forms a gapless bezel around a periphery of the wireless device.

4. The device of claim 1, wherein a back of the housing includes conductive metal.

5. The device of claim 1, wherein a back of the housing includes conductive metal and plastic.

6. The device of claim 1, wherein the continuous conductor forms a closed loop around a periphery of the housing.

7. The device of claim 1, wherein the first and second portions overlap.

8. The device of claim 1, wherein the wireless device is configured to transmit simultaneously via the first loop and the radiating spur.

9. The device of claim 1, wherein the radiating spur is configured to operate as a high band antenna, and the first loop is configured to operate as a low band antenna.

10. The device of claim 1, wherein the first loop is configured to transmit in a first frequency, and wherein the radiating spur is configured to transmit in a second frequency higher than the first frequency.

11. A wireless device, comprising:

a dielectric substrate;

a counterpoise disposed on the dielectric substrate;

a conductive frame disposed around the dielectric substrate;

a coupling element galvanically connected to the counterpoise and arranged to capacitively couple to a feed point through a feed element;

a connector element connecting the conductive frame to the counterpoise, the connector element, at least a portion of the conductive frame, the counterpoise, and the coupling element forming a first loop antenna, wherein the connector element and the at least a portion of the conductive frame resonant in a first frequency when fed a signal from the coupling element; and a radiating spur antenna, sandwiched between the conductive frame and the counterpoise, the radiating spur antenna comprising the feed element and the coupling element, the radiating spur not forming a part of the conductive frame and the counterpoise, wherein the radiating spur antenna is configured to resonate in a second frequency.

12. The device of claim 11, wherein the conductive frame is continuous.

13. The device of claim 11, wherein the conductive frame forms an exterior bezel of the wireless device.

14. The device of claim 11, wherein the first loop antenna and the radiating spur antenna share the counterpoise.

15. The device of claim 11, further comprising a third antenna, having a third resonant frequency, and connected to the counterpoise.

16. The device of claim 11, wherein the first frequency differs from the second frequency.

17. The device of claim 11, wherein the first frequency and the second frequency are substantially the same.

18. An antenna for a wireless device, comprising:

a dielectric substrate;

a counterpoise disposed on the dielectric substrate;

a conductive frame surrounding the counterpoise;

a first conductive element galvanically connected to the counterpoise; and a second conductive element galvanically connected to a feed point and capacitively coupled to the first conductive element;

wherein the first conductive element and at least a portion of the conductive frame form at least a portion of a radiating loop resonant at a first frequency when the feed point is fed a signal, the first conductive element not being galvanically connected to the feed point; and wherein the first conductive element and the second conductive element form at least a portion of a radiating spur resonant at a second frequency higher than the first frequency when the feed point is fed a signal.

19. The device of claim 18, wherein at least a portion of the conductive frame forms a portion of the radiating spur.

20. The device of claim 18, wherein the conductive frame forms an external bezel of the wireless device.

21. The device of claim 18, wherein at least a portion of the counterpoise forms a portion of the radiating loop.

22. The device of claim 18, wherein at least a portion of the counterpoise forms a portion of the radiating spur.

* * * * *